United States Patent [19]

Limp

[11] Patent Number: 4,648,229

[45] Date of Patent: Mar. 10, 1987

[54] SUSPENDED CEILING SYSTEM HAVING TILES WITH INTERSPERSED HOOKS RESTING ON RUNNERS

[76] Inventor: Edgar W. Limp, 1103 E. Campbell, Arlington Heights, Ill. 60004

[21] Appl. No.: 473,106

[22] Filed: Mar. 7, 1983

[51] Int. Cl.[4] ..... E04B 5/52

[52] U.S. Cl. ..... 52/484; 52/774; 52/778

[58] Field of Search ..... 52/484, 488, 489, 774, 52/776, 778, 475, 476, 729, 720

[56] References Cited

U.S. PATENT DOCUMENTS

| | | | |
|---|---|---|---|
| 1,073,805 | 9/1913 | Kinneat | 52/774 |
| 2,993,240 | 7/1961 | Erikson | 52/778 |
| 2,994,113 | 8/1961 | Dail | 52/484 |
| 3,049,204 | 8/1962 | Sorenson | 52/484 X |
| 3,087,205 | 4/1963 | Mancini | 52/475 |
| 3,287,874 | 11/1966 | Stahlhut | 52/720 |
| 3,832,816 | 9/1974 | Jahn | 52/779 |
| 3,988,871 | 11/1976 | Moomey | 52/484 |
| 4,057,947 | 11/1977 | Oide | 52/496 |
| 4,089,146 | 5/1978 | Martinez | 52/484 |

FOREIGN PATENT DOCUMENTS

| | | | |
|---|---|---|---|
| 59082 | 3/1912 | Switzerland | 52/484 |

*Primary Examiner*—Carl Friedman
*Assistant Examiner*—Naoko N. Slack
*Attorney, Agent, or Firm*—Eugene F. Friedman

[57] ABSTRACT

A suspended ceiling system having tiles and fixtures with interspersed hooks resting on runners. The hooks from adjacent ceiling components rest on the top of the same runners, but not upon each other. Each tile, consequently, may undergo removal without interfering or disturbing any of its neighbors. The tiles may have kerfing and backcutting with a metal bracket, or spline, inserted in the kerfing. The hooks extend from the metal bracket upwards and over the top of the suspended runners. Generally, the location of the hooks and spaces form mirror images of each other through a plane passing through the middle of the tile. When used on the opposite side for a neighboring tile, the hooks from either tile land in the space between the hooks on the other tile. Although resting on top of the same runner, they do not lie on top of each other, permitting the removal of one tile without disturbing any others. The same arrangement of hooks and spaces may form part of other ceiling fixtures such as lights, vents, or speakers. These fixtures too may consequently rest on the same runners and undergo removal without disturbing neighboring tiles or fixtures.

31 Claims, 7 Drawing Figures

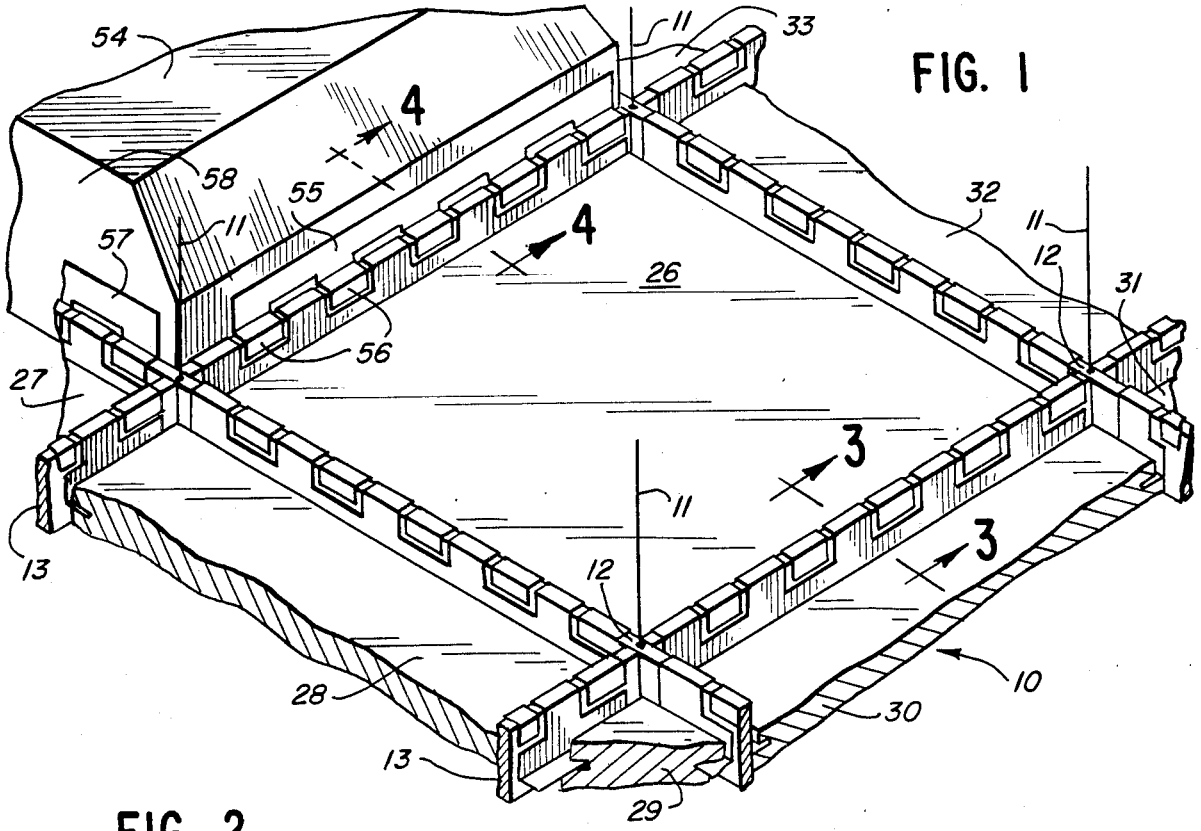
FIG. 1
FIG. 2
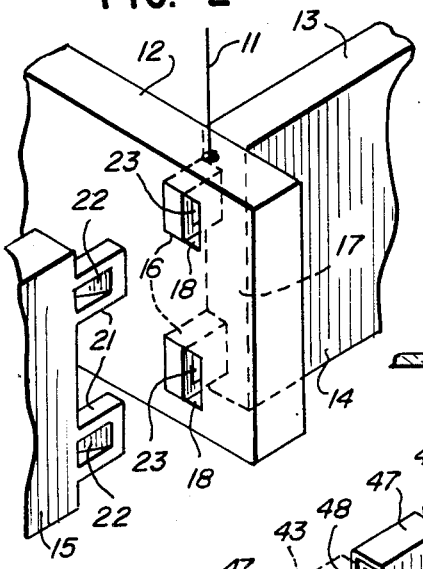
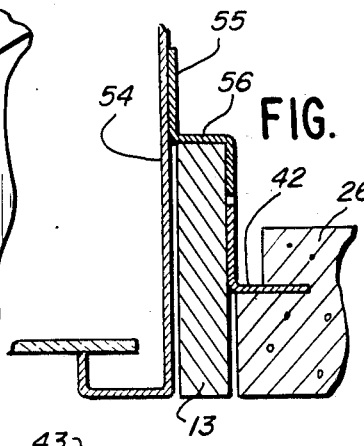
FIG. 4
FIG. 3
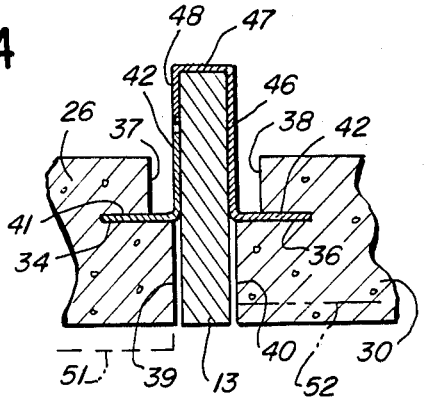
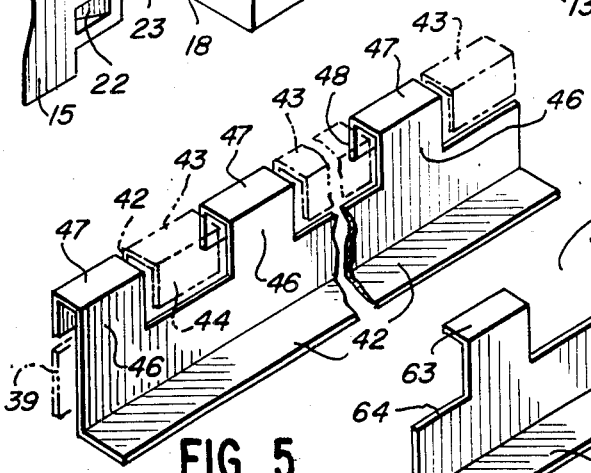
FIG. 5
FIG. 6
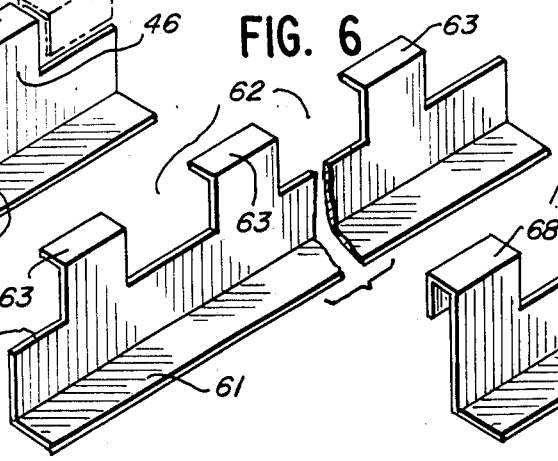
FIG. 7
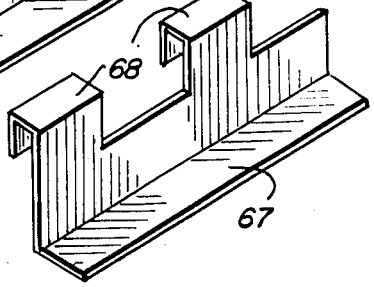

SUSPENDED CEILING SYSTEM HAVING TILES WITH INTERSPERSED HOOKS RESTING ON RUNNERS

BACKGROUND

In most modern office buildings, a room's ceiling does not attach to the uppermost surface of the room. Rather, a suspension system supports the ceiling at a distance below the upper surface. A plenum then represents the space between the room's uppermost surface and its ceiling.

Classically, a suspended ceiling has taken one of two different forms. The first employs runners of an appreciable width which remain visible at all times. Intersecting pairs of parallel runners serve to define a rectangular open space between them. A ceiling tile of an appropriate dimension sits on top of the runners where it stays under the influence of gravity. The outer perimeter of the tile has a greater dimension than the defined space between the runners. To remove a tile simply involves lifting the tile off the runners and manipulating it through its own opening. Alternately, a tile can move to an adjacent space and rest temporarily upon another tile. Installing a tile merely requires placing it through the opening and resting it with the flat, pleasing appearance facing downwards and its edges resting on the runners.

The type of gravity-held ceiling system described above has various natural advantages. Any tile may undergo removal to permit access to the plenum at its location. Substitution of a new tile, concommitantly, represents a very facile task.

However, the runners do not always present a pleasing appearance. They necessarily constitute strips of substantial width which always remain accessible to view. Thus, the ceiling has a grid pattern of these strips marring the appearance presented by the tiles themselves. Furthermore, the junctures where the runners cross may prove even less aesthetically pleasing.

Additionally, the tiles do not have positive placement on the runners. As a consequence, slight movement may cause an edge of a tile to become visible.

An alternative system finding frequent use does not employ visible runners. This system employs kerfed and back-cut tiles. The support system for this type of ceiling employs hidden runners that interconnect the tiles together. The visible bottoms of the tiles contact each other to provide a desirable appearance.

However, removing the tiles represents a difficult task at best. Only a small number of the tiles may undergo removal without first affecting the other tiles. To obtain access to the plenum above the tiles or replacing a damaged tile at a specific location may require the removal of a substantial portion of the ceiling. Furthermore, the person seeking access to the plenum or removing a tile must know which individual tiles in particular must undergo initial removal.

Various modifications to the two systems described above have attempted to ameliorate at least some of their drawbacks. A. A. Mancini, in his U.S. Pat. No. 3,087,205, and P. D. Dail, in his U.S. Pat. No. 2,994,113, use kerfed tiles adjoined into rows through interconnecting splines. However, on the free edges, they attach a bracket with hooks. These hooks sit on an upstanding edge of a runner suspended from the upper surface. The tiles thus all have a positive connection to other tiles and rest on the suspension system. Moreover, removing an entire row represents a relatively facile task.

However, Mancini and Dail have a number of drawbacks from the two basic types of systems described above. They still has relatively wide runners that detract from the appearance of the ceiling. Moreover, their systems do not permit the facile removal of individual tiles; an entire row going across the room must undergo removal at the same time. At the very minimum, removing one tile affects its neighbors.

U.S. Pat. No. 4,089,146 to V. Martinez, shows a system which similarly includes rows of tiles linked to each other with cross T's inserted in their kerfed sides. One end of each tile also has kerfing. This slot receives, in a close friction fit, a flange of a main supporting runner. A hook forming part of the cross T attaches to a second runner to hold the other end of the tile in place. A special tool permits the disengagement of the hook from the runner to initiate removal of a tile.

Again, Martinez has rows of tiles attached to each other. He does not provide a facile method for removing a single tile at a time. Furthermore, removal of any of the tiles requires the tool and a knowledge as to where to use the instrument. Again, access to a particular area of the plenum or the removal of a particular tile in general represents a complicated task.

K. Oide, in his U.S. Pat. No. 4,057,947, provides a ceiling system which does not require exposed runners. Oide provides T-shaped clips inserted into the tiles' kerfing. The extended leg may then fold over joists attached to the room's upper surface to attach the tiles. Oide, however, does not address himself to the problem of the facile removal of individual tiles.

W. M. Erikson, in his U.S. Pat. No. 2,993,240, provides a ceiling with contacting tiles. Cross T's inserted in the tiles' kerfings holds them together. However, a number of the tiles have a sufficient backcutting that in fact the kerfing disappears, leaving only a lower ridge. Without an upper flange, the cross T's do not support these tiles. To keep these tiles in place, they have moveable slides which can rest on runners to support the ends of these tiles. Tongues depending through spaces between tiles allow repositioning of the slide for the insertion and removal of the tiles. However, the tongues themselves detract from the smooth surface of the ceiling. Moreover, only a limited number of the tiles have this removable feature. Accordingly, the removal of any particular tile or access to the plenum at that particular location may require the disassembly of other portions of the ceiling.

In M. D. Jahn's U.S. Pat. No. 3,832,816, parallel runners with upturned edges support the ends of tiles linked together in rows. The lower surface of the tiles has kerfing into which fit the upturned edges of the runners. By moving a portion of material on the lower surfaces at the edges of the tiles permits the runners to have a recessed location between tiles. However, the runners still remain visible. Furthermore, they must have sufficient width to support the edges of two adjacent rows of tiles. Moreover, adjacent tiles in a row may only touch each other with no connection or, alternatively, with a tongue and groove or lap joint. In the former case, the edges of the tile do not receive support from each other. In the latter, removal of an individual tile again proves problematic.

L. G. Stahlhut's U.S. Pat. No. 3,287,874 has a grid pattern of runners. A bevel on the edge of the runners holds flanges or extending lugs cut from the edges of the tiles. Flexing the tiles permits their insertion and removal. However, the runners must have sufficient width to allow for the entrance of clips used to hold the runners to the room's upper surface. Furthermore, a space must separate the bottoms of the tiles from the runners; the space allows the flexing of the tiles for their insertion or removal. Furthermore, the system requires a tile having sufficient structural integrity for their lugs to rest on the extending bevels and not crumble under their own weight.

Accordingly, the search continues for a ceiling system which permits the facile removal of any individual tile. Yet, to achieve a pleasing aesthetic appearance, the runners used should not seriously detract from the ceiling's appearance.

SUMMARY

Using hooks extended across the tops of runners to support the tiles permits the minimization of the width of the runners. They do not have to have sufficient area for the tiles to lie upon them; very thin runners can provide support for the hooks passing over their tops.

Kerfing and backcutting in the tiles permits the installation of the hooks without damaging the tiles. Furthermore, with the hooks passing up through the area left vacant by the backcutting permits the tiles to lie adjacent to the runners. The resulting ceiling has very thin runners between the tiles to provide an aesthetically pleasing appearance.

The hooks from a particular tile should generally not occupy a majority of the runner on top of which it lies. Rather, it should have sufficient space to allow for the placement directly on the runner of the hooks from the tile on the other side of the runner. Typically, each tile will have a spline in its kerfing that will extend several hooks onto the runner. Wherever the spline has a hook, at an equidistant on the other side of the spline's midpoint, it will have a space. This allows the use of the same spline on the neighboring tile and provides assurance that its hooks will land directly on the runner and not on the hooks of the first tile. Thus, moving one of the tiles does not affect its neighbor on the other side of the runner.

In general terms, the suspended ceiling system includes first a support member. These members, of course, serve to hold the tiles at a desired distance from the room's upper surface.

The system next includes a suspension device which retains the support member at a predetermined height above the room's floor. Typically, the suspender utilizes thin metal rods connected both to the upper surface of the room and to the support members themselves.

The ceiling system further utilizes two ceiling components. The components lie adjacent to the same portion of the support member. One of the components, at that location, lies on one side of the member while the other component, at the same location, remains on the member's other side.

A first coupling device attaches to the first component and extends across a first portion of the top of the support member. This first device has the function of supporting the first ceiling component at some distance above the floor of the room.

Similarly, a second coupling device attaches to the second ceiling component. It too extends across the top of a support member. However, the portion of the top of the member contacted by the second coupler differs from that touched by the first coupler. By resting on different portions of the support member, either component may undergo removal and replacement without affecting the other.

Typically, the member takes an elongated form and receives the appellation of "runner". The first and second components, disposed on either side of the runner, extend along and occupy approximately the same location along that runner, but on opposite sides.

The couplers themselves generally take the form of hooks. In other words, not only do they extend across the top of the runner, but they extend downward on the opposite side to provide a more secure attachment. Furthermore, a careful choice of the shape of the coupler allows the use of the same manufactured piece on the two tiles facing each other on opposite sides but at the same positions along the runner. Basically, the hooks of the coupling device should have a bilateral assymetry about the midpoint of the coupler. In other words, if it has a hook located at a particular distance on one side of the midpoint, it should have a space on the other side. Turning the coupler around to use it for the other ceiling tile will thus place hooks at locations where spaces exist from the first coupler. Making the hooks somewhat shorter than the spaces helps keep the tiles from interfering with each other.

In particular, to make sure that the two couplers do not interfere, they should each occupy less than about half the space on top of the runner between the two ceiling components. This allows for some slight misadjustment in placing the tiles or the couplers and yet not have the two bother one another.

The couplers, or splines, include hooks spaced along its entire length. At a minimum, it will have usually at least one hook on either side of the spline's midpoint. This provides support along most of the tile's edge.

Furthermore, the very ends of the splines typically should have no hook at all. A hook at the tile's end could interfere with cross-linked runners along adjacent sides of the ceiling component.

Typically, the ceiling system includes a grid of intersecting runners. In most instances, the grid consists of a first set of parallel runners perpendicularly intersecting a second set of parallel runners to form rectangular spaces. Ceiling components then fill these spaces. The components can include ceiling tiles, light fixtures, sound speakers, or vent outlets.

However, different grid patterns can produce other, pleasing aesthetic effects. Thus, other polygonal shapes besides a rectangle may result. In any event, the adjacent runners typically will make an angle of at least 60° with each other; for perpendicular intersection, of course, the angle amounts to 90°; for polygons with more sides, the angle will exceed 90°.

BRIEF DESCRIPTION OF THE FIGURES

FIG. 1 shows a portion of a ceiling tile system including one full ceiling tile, portions of seven adjacent ceiling tiles, and a light fixture.

FIG. 2 displays a juncture of two runners that does not affect their upper, load-bearing, surfaces.

FIG. 3 gives a cross-sectional view along the line 3—3 of FIG. 1 showing a runner supporting ceiling tiles on either side. In phantom appears tiles having their lower surfaces at different heights above the floor to produce a further aesthetic effect.

FIG. 4 gives a cross-sectional view along the line 4—4 of FIG. 4 displaying a runner supporting on one side a ceiling tile and, on the other side, a light fixture.

FIG. 5 portrays a spline from a first ceiling tile in solid lines and the spline from a tile on the other side of a runner, omitted for clarity, in dotted lines.

FIG. 6 shows a spline standing by itself having several couplers which do not extend down on the opposite side of the runner as well as other modifications.

FIG. 7 shows a spline having but two hooks.

DETAILED DESCRIPTION

The ceiling tile system, shown generally at 10 in FIG. 1, includes first the metal rods 11 which generally have attachments to the room's upper surface. These rods 11, at their other ends, connect to the main runners 12 which typically run from wall to wall in a room. Alternatively, natively, the main runners 12 may include several components attached to each other. To form a grid work, the support system includes the cross runners 13 which connect to each other and to the main runners 12.

FIG. 2 shows one method of interconnecting the pieces. The cross runner 13 actually includes the two sections 14 and 15. The first cross runner section 14 has the two lugs 16 extending from its end 17 and into the openings 18 through the main runner 12.

Similarly, the second cross-runner section 15 includes the lugs 21 which forms a friction fit with the first set of lugs 16 in the openings 18. The metal tabs 22 on the lugs 21 extend beyond their inner surface to enter the openings 23 in the lugs 18. When the tabs 22 enter the openings 23, they prevent the two lugs, and thus the two cross-runner sections 14 and 15, from separating from each other. This interconnection, of course, assists the friction-fit in the opening 18 to maintain the system as one solid unit.

In FIG. 1, the ceiling system 10 includes the ceiling tile 26 surrounded by two main runners 12 and two cross runners 13. Portions of the ceiling tiles 27, 28, 29, 30, 31, 32, and 33 also derive support, in part, from the runners 12 and 13.

FIG. 3 shows the manner of supporting the ceiling tiles 26 and 30 on the cross runner 13. The same support structure also holds the tiles onto the main runners 12. In particular, both of the tiles 26 and 30 have the slots 34 and 36, known as kerfing, placed in their sides. They also have the backcutting which results in their upper edges 37 and 38 not extending as close to the runner 13 as their lower edges 39 and 40, respectively. The backcutting allows the tiles 26 and 30 to lie adjacent to the runner 13 and yet provides space adjacent to the surfaces 37 and 38 for other mechanisms.

In particular, the splines 41 and 42 sit in the kerfings 34 and 36, respectively. The spline 41 then bends to a horizontal portion 42 across the top of the runner 13 and down on the other side of the runner. The descending hook portion 44, not seen in FIG. 3, appears in phantom in FIG. 5.

Similarly, the spline 42, from the kerfing 36, bends into the vertical portion 46 which ascends the runner 13. Its horizontal segment 47 sits on the runner 13. Lastly, the descending hook portion 48 assures a proper and secure grip on the runner 13. Naturally, however, the spline 42 has a sufficiently loose fit on the runner 13 to allow for its facile installation and removal.

The dashed lines 51 and 52 show that the ceiling tiles need not have the same thickness or, consequently, sit at the same height above the room's floor. Having various tiles occupying different horizontal planes may produce a pleasing aesthetic effect.

In FIG. 1, the ceiling tile system 10 also includes the light fixture 54. The fixture 54 sits on the runner system in the same fashion as does a tile. As shown in FIGS. 1 and 4, the bracket 55 attaches to the fixture 54 and sits upon the runner 13. In particular, the bracket 55 includes the legs 56 which extend over and down on the other side of the runner 13 to help keep the light fixture 54 in place. A similar bracket 57 on the fixture's end 58 sits on the runner 12 to similarly support the fixture 54. In fact, brackets on the light's ends only may provide sufficient support.

A suitable pattern for the hooks from opposing splines or brackets appears in FIG. 5. As shown there, the tops 47 of the hooks on the spline 42 sit on a runner, but include spaces between them. Within these spaces fit the tops 43, shown in dashed lines, of the hooks from the spline 39 affixed to the adjacent ceiling tile. The same pattern for the tops of the hooks 43 would, of course, apply to the hooks 56 from the bracket 55.

The spline 61 in FIG. 6 exhibits a number of minor differences from the spline 42 of the prior figures. Initially, it has proportionately larger spaces 62 between the hooks 63. This helps avoid the hooks from adjacent tiles or other fixtures interferring with each other during their installation or removal. In particular, the space of 62 and the spline 61 constitutes well over half of the length of the spline 61. However, even for the spline 42, the hooks 46 constitute less than the length of the spline.

Further, the hooks 63 have no descending portions to form a solid grip on the runners. The runners may, in fact, have sufficient rigidity that a mere gravity placement of the hooks 63 will suffice to retain the tile in place. Eliminating the descending portions again facilitates the insertion or removal of the spline 61 and the attached tile or other ceiling fixture.

Additionally, the spline 61 has the portion 64 which, although at the end with the hook, itself remains free of the hook portion. Making sure that the ends of the spline 61 have no hook avoids any possible interference that can occur at the juncture of runners during the insertion of the spline 61. Were the hooks to run all the way to the spline's end, interference of the spline with the intersection of main and cross runners could result.

The spline 67 in FIG. 7 has a similar appearance to the spline 42 of FIG. 5. However, it only has two hooks 68 which will sit on the suspended runners. In particular, each half of the spline has one hook. Because of the rigidity of the construction of the spline 67, a reduced number of hooks 68 may suffice to provide the requisite support for the ceiling tiles or other fixtures.

The use of the hooks and runners to support the ceiling tile system 10 in FIG. 1 produces various advantages. It permits the use of very thin runners 12 and 13. These produce a more pleasing aesthetic appearance than the wide runners currently finding use for the ceiling system with individually removeable tiles. In fact, runners having a width no greater than about $\frac{3}{8}$ inch can serve to support the suspended ceiling system.

However, the tiles still rest under the force of gravity upon the runners. Thus, they may undergo facile installation and removal. Furthermore, the system can find use with kerfed and back-cut ceiling tiles as presently produced.

Additionally, the system, in the same fashion, allows the installation of other types of ceiling fixtures. These fixtures can include lights, speakers, or vent fixtures. Again, the installation or removal of these components as well as the ceiling tiles themselves need not perturb their neighboring components.

Accordingly, what is claimed is:

1. A suspended ceiling system for a room comprising:
(A) an elongated support member having a first end and a second end;
(B) suspension means for retaining said support member at a predetermined height above the floor of said room;
(C) first and second ceiling components located adjacent to and, at least in part, at the same location along said member, said first component, at said location, being on one side of said member and said second component, at said location, being on the other side of said member;
(D) first coupling means, attached to said first ceiling component and extending across a first longitudinal portion of the top of said support member, for supporting said first ceiling component at a distance above the floor of said room; and
(E) second coupling means, attached to said second ceiling component and extending across a second longitudinal portion of the top of said support member, each of the points of said second portion being located at a longitudinal position different than the points of said first portion, for supporting said second component at a distance above the floor of said room.

2. The system of claim 1 wherein said first component extends along said member on said one side at all points where said second component extends, on said other side, along said member.

3. The system of claim 2 wherein each of said first and second coupling means occupies, of the top of said member, a length that is less than about half the maximum dimension of said first and second components, respectively, in the direction of said member.

4. The system of claim 3 wherein said first and second coupling means extend down along said other and said one sides, respectively, of said member.

5. The system of claim 4 wherein said support member includes a plurality of runners located along different sides of said first component.

6. The system of claim 5 wherein said first component includes one of said runners along a first edge and another of said runners along a second edge and wherein said first and second edges make an angle relative to each other of not less than about 60°.

7. The system of claim 6 wherein said first coupling means attaches to said first edge of said first component and includes a plurality of hooks extending along the top of said first runner.

8. The system of claim 7 wherein said support members have a width no greater than $\frac{3}{8}$ inch.

9. The system of claim 7 wherein said first and second coupling means extend down along said other and said one sides, respectively, of said member.

10. The system of claim 7 wherein each of said hooks has a rigid configuration relative to said first component.

11. The system of claim 10 wherein each of said hooks has a rigid configuration relative to said first component.

12. The system of claim 10 wherein said first component lies adjacent to said one side and said second component lies adjacent to said other side of said member.

13. The system of claim 12 wherein said support members have a width no greater than $\frac{3}{8}$ inch.

14. The system of claim 12 wherein each of said first and second coupling means comprises a plurality of hooks extending up along said one and said other sides, respectively, of said member across the top of said member, and down along said other and said one sides, respectively, of said member.

15. The system of claim 14 wherein said support members have a width no greater than $\frac{3}{8}$ inch.

16. The system of claim 14 wherein said first and second coupling means extend down along said other and said one sides, respectively, of said member.

17. The system of claim 12 wherein said support member includes a plurality of cross-linked runners.

18. The system of claim 17 wherein said support members have a width no greater than $\frac{3}{8}$ inch.

19. The system of claim 17 wherein said cross-linked runners determine a plane and form rectangular openings, said first and second components have rectangular cross sections in the plane determined by said support member, and said first coupling means includes hooks attached to two parallel sides of said first member and said second coupling means includes hooks attached to two parallel sides of said second component.

20. The system of claim 19 wherein said support members have a width no greater than $\frac{3}{8}$ inch.

21. The system of claim 19 wherein said first and second coupling means extend down along said other and said one sides, respectively, of said member.

22. The system of claim 19 wherein each of said first and second components is a light, a ceiling tile, a speaker, or a vent fixture.

23. The system of claim 22 wherein said support members have a width no greater than $\frac{3}{8}$ inch.

24. The system of claim 22 wherein said first component is a ceiling tile and is kerfed and back-cut and wherein said first coupling means includes a rigid member inserted in the kerfing in said first component.

25. The system of claim 24 wherein said hooks of said first member are spaced apart from each other and said hooks of said second member are spaced apart from each other and the spaces between said hooks of said first member are greater than the width of any of said hooks of said first member and the spaces between said hooks of said second member are greater than the width of any of said hooks of said second member.

26. The system of claim 25 wherein said support members have a width no greater than $\frac{3}{8}$ inch.

27. The system of claim 25 wherein said first component includes holders along all four sides of said component.

28. The system of claim 27 wherein said support members have a width no greater than $\frac{3}{8}$ inch.

29. An elongated spline for use with a suspended ceiling system for a room including:
(1) an elongated support member;
(2) suspension means for retaining said support member at a predetermined height above the floor of said room; and
(3) a ceiling component having a plurality of edges with one of said edges located adjacent to said member, said spline comprising:
(A) an elongated holding member having a midpoint;
(B) attaching means for affixing said holding member to said component;
(C) coupling means, attached to said member, for extending across the top of said support member, said coupling means being arranged such that, for each point located at a particular distance on one side of said midpoint where said coupling means extends across the top of said support member, at the point at said particular distance on the other side of said midpoint, no part of said coupling means extends across the top of said support member.

30. The spline of claim 29 wherein said coupling means includes a plurality of hooks capable of extending across the top of said support member, at least one of said hooks being located on each side of said midpoint.

31. The spline of claim 30 wherein each of said hooks extends down along the side of said support member opposite to the side adjacent to which said ceiling component lies.

* * * * *